US006249486B1

(12) United States Patent
Chitturi

(10) Patent No.: US 6,249,486 B1
(45) Date of Patent: Jun. 19, 2001

(54) LINEAR TIME DISPLAY

(75) Inventor: Prasanna R. Chitturi, 7430 Laurel Ct., Pleasanton, CA (US) 94588

(73) Assignee: Prasanna R. Chitturi, Pleasanton, CA (US)

( * ) Notice: Subject to any disclaimer, the term of this patent is extended or adjusted under 35 U.S.C. 154(b) by 0 days.

(21) Appl. No.: 09/164,411

(22) Filed: Sep. 30, 1998

(51) Int. Cl.[7] ..... G04B 19/22
(52) U.S. Cl. ..... 368/21; 368/223
(58) Field of Search ..... 368/21, 25, 228, 368/232, 239, 76, 242

(56) References Cited

U.S. PATENT DOCUMENTS

| | | | | |
|---|---|---|---|---|
| 1,927,235 | | 9/1933 | Heimann . | |
| 2,024,066 | | 12/1935 | Segovia . | |
| 2,063,491 | | 12/1936 | Harm . | |
| 2,277,804 | | 3/1942 | Wapner . | |
| 2,299,913 | | 10/1942 | Clough . | |
| 3,002,337 | | 10/1961 | Smith . | |
| 3,956,879 | | 5/1976 | Bailey . | |
| 4,103,484 | | 8/1978 | Bailey . | |
| 4,161,098 | * | 7/1979 | Ingendahl | 368/76 |
| 4,669,891 | | 6/1987 | Rosevear . | |
| 4,681,460 | | 7/1987 | Nishimura . | |
| 4,884,254 | | 11/1989 | Kawai et al. . | |
| 4,887,251 | * | 12/1989 | Takada | 368/21 |
| 4,972,392 | | 11/1990 | Willington . | |
| 5,007,033 | | 4/1991 | Kubota et al. . | |
| 5,054,008 | | 10/1991 | Darling . | |
| 5,408,445 | * | 4/1995 | Allgaier et al. | 368/21 |
| 5,448,532 | | 9/1995 | Kataoka et al. . | |
| 5,555,226 | | 9/1996 | Lizzi . | |
| 5,907,523 | * | 5/1999 | Richins | 368/21 |

FOREIGN PATENT DOCUMENTS

| | | | | |
|---|---|---|---|---|
| 480800 | * | 3/1938 | (GB) | 368/25 |

* cited by examiner

*Primary Examiner*—Bernard Roskoski
(74) *Attorney, Agent, or Firm*—Columbia IP Law Group, LLC

(57) ABSTRACT

A linear time display including a first and a second time clock for a first and a second locale of a first and a second time zone is disclosed. In one embodiment, each linear time clock includes a plurality of time unit representations. A first visual indicator is displayed to correlate a first time unit representation in the first linear clock to a corresponding time unit representation in the second linear clock, and a second visual indicator is displayed to correlate a second time unit representation in the second linear clock to a corresponding time unit representation in the first linear clock. A time difference represented by the spatial difference between the first and second visual indicators is also displayed.

12 Claims, 6 Drawing Sheets

300

| 304 LOCALE NAME | 306 COUNTRY | 308 LOCALE ABBREVIATION | 310 +/- GMT | 312 DAYLIGHT SAVINGS TIME? |
|---|---|---|---|---|
| 302 San Francisco | USA | SFO | -8:00 | Y |
| | | | | |
| | | | | |
| | | | | |

FIG. 3

400

CITY: _____
COUNTRY: _____
ABBREVIATION: _____
GMT OFFSET: _____
DAYLIGHT SAVINGS TIME? (Y/N): _____

402

DONE CANCEL

404

FIG. 4

500

| CITY | ABR | +/- GMT |
|---|---|---|
| Addis, Ababa, Ethiopia | ABA | +3:00 |
| Adelaide, Australia | ADL | +9:30 |
| London, UK | LDN | 0:00 |
| New York, USA | NYC | -5:00 |
| San Francisco, USA | SFO | -8:00 |
| Tokyo, Japan | TKY | +9:00 |

502

Look Up:_____ <CMD> △ ▽

504 508 506

FIG. 5

600

| 602 CITIES | 604 OPTIONS | 606 DISPLAY |
|---|---|---|
| Show List | Home City | Day |
| Add City | City 1 | Evening |
| Del City | City 2 | 1st Crossbar |
| | City 3 | 2nd Crossbar |

FIG. 6

LINEAR TIME DISPLAY

BACKGROUND OF THE INVENTION

1. Field of the Invention

The present invention relates to the field of time display. More specifically, the present invention relates to the display of time for multiple locales in multiple time zones.

2. Background Information

Numerous time display devices supporting display of time for multiple locales in multiple time zones are known in the art. See for example, U.S. Pat. Nos. 5,555,226, 5,448,532, 5,054,008, 5,007,003, 4,972,392, 4,884,254, and 4,681,460, to name just a few. However, these prior art time display devices typically suffer from at least one of two disadvantages. They are either unable to concurrently display time for multiple locales in multiple time zones, or they are confined to the globe paradigm, that is displaying time for multiple locales in multiple time zones in a globe related presentation. As a result, these prior art time display devices are user unfriendly in answering certain time related questions frequently asked by world travelers. Examples of these frequently asked time related questions include questions such as the appropriate "local" time in an oversea location for a traveler to call home, the appropriate time to schedule a conference call involving participants located in multiple time zones, and flight time (as itinerary is often given in terms of local take off time in a first time zone, and local arrival time in a second time zone). Increasing number of world travelers are asking these and many other basic time related questions, as the continuing globalization of the world's economy causing more and more businessmen to travel, and the increasing affluence of the developed world causing more and more vacationers to travel to more distant places. Thus, an improved method for displaying time for multiple locales in multiple time zones that is more user firendly and without the disadvantages of prior art approaches is desired.

SUMMARY OF THE INVENTION

A linear time display including a first and a second time clock for a first and a second locale of a first and a second time zone is disclosed. In one embodiment, each linear time clock includes a plurality of time unit representations (TUR). A first visual indicator is displayed to correlate a first TUR in the first linear clock to a corresponding TUR in the second linear clock, and a second visual indicator is displayed to correlate a second TUR in the second linear clock to a corresponding TUR in the first linear clock. A time difference represented by the spatial difference between the first and second visual indicators is also displayed.

In one embodiment, the time unit representations are hour slots, and the correlating visual indicators are crossbars. Furthermore, the hour slots are visually differentiated between the daytime ones and the evening ones.

BRIEF DESCRIPTION OF DRAWINGS

The present invention will be described by way of exemplary embodiments, but not limitations, illustrated in the accompanying drawings in which like references denote similar elements, and in which:

FIG. 3 illustrates one embodiment of a data structure suitable for use to practice the present invention;

FIG. 4 illustrates one embodiment of an input display suitable for use to collect data for a customized locale;

FIG. 5 illustrates one embodiment of a display list suitable for use to practice certain aspects of the present invention;

FIG. 6 illustrates one embodiment of a menu suitable for use to practice various other aspects of the present invention;

DETAILED DESCRIPTION OF THE INVENTION

In the following description, various aspects of the present invention will be described. However, it will be apparent to those skilled in the art that the present invention may be practiced with only some or all aspects of the present invention. For purposes of explanation, specific numbers, materials and configurations are set forth in order to provide a thorough understanding of the present invention. However, it will also be apparent to one skilled in the art that the present invention may be practiced without the specific details. In other instances, well known features are omitted or simplified in order not to obscure the present invention.

Parts of the description will be presented in terms of operations performed by a computer system, using terms such as tables, files, data and the like, consistent with the manner commonly employed by those skilled in the art to convey the substance of their work to others skilled in the art. As well understood by those skilled in the art, these quantities take the form of electrical, magnetic, or optical signals capable of being stored, transferred, combined, and otherwise manipulated through mechanical and electrical components of a digital system; and the term digital system includes general purpose as well as special purpose data processing machines, systems, and the like, that are standalone, adjunct or embedded.

Various operations will be described as multiple discrete steps performed in turn in a manner that is most helpful in understanding the present invention, however, the order of description should not be construed as to imply that these operations are necessarily order dependent, in particular, the order the steps are presented.

Figure 1:
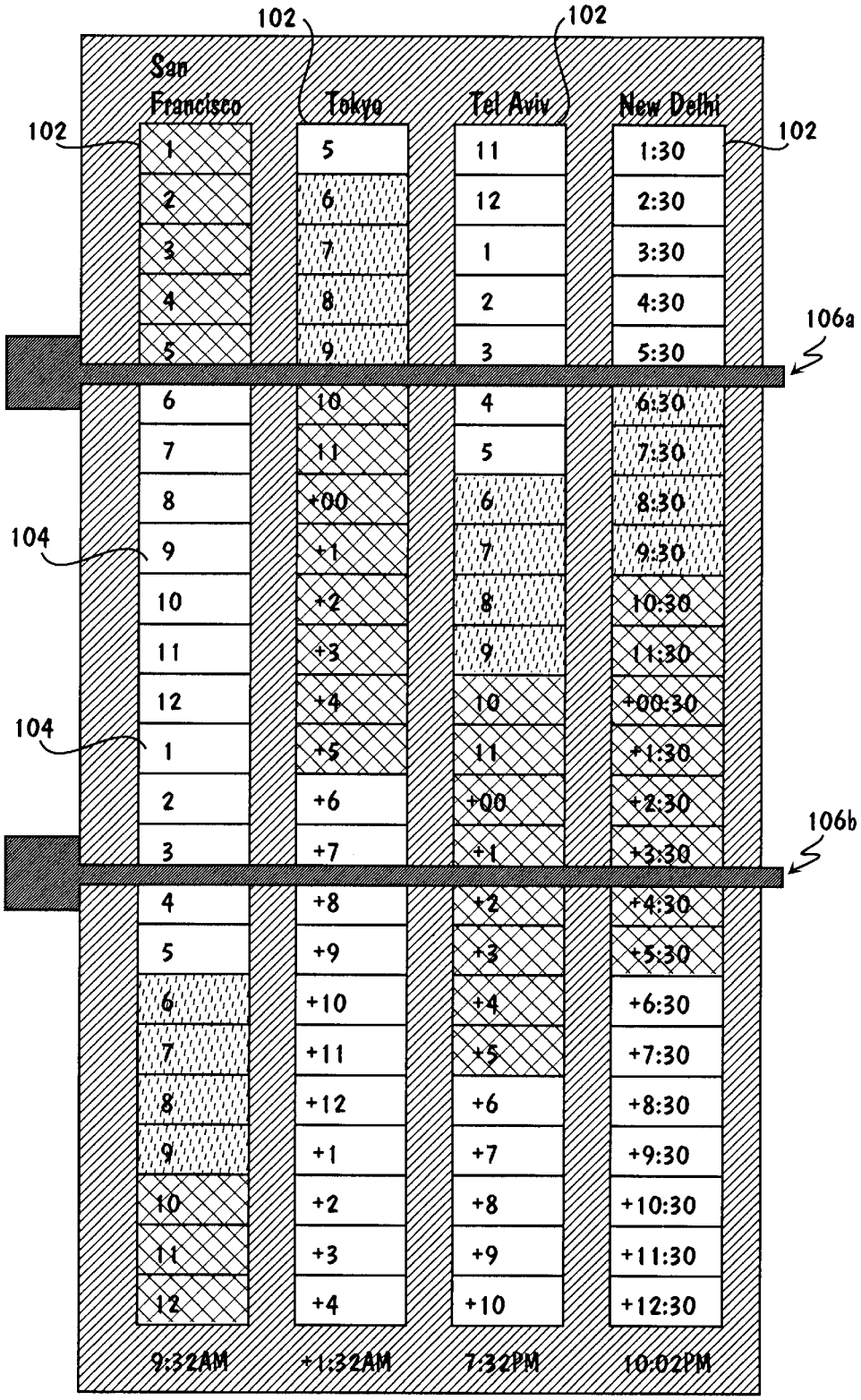
FIG. 1 illustrates one embodiment of the linear time display of the present invention.

Referring now to FIG. 1, wherein an overview of one embodiment of the linear time display of the present invention is shown. As illustrated, linear time display 100 of the present invention includes a number of linear clocks 102. Each linear clock 102 shows the time for a locale in a time zone. The term "locale" as used in this specification refers to a geographical location, which includes but not limited to a village, a town, a city, a county, a metropolitan area, and so forth. While nothing in the present invention prevents the time displayed for some or all of the different locales to be in the same time zone, typically, each of the linear clocks 102 displays time for a locale of a different time zone. For the illustrated embodiments, linear clocks 102 are displayed in a vertical orientation. In alternate embodiment, linear clocks 102 may be displayed in a horizontal orientation instead.

Each linear clock 102 is constituted with a number of time unit representations (TUR) 104. For the illustrated embodiment, the time unit representations 104 are hour slots. Linear clocks 102 are displayed with the corresponding hour slots aligned. That is, if locale-2 is ahead of locale-1 by 16 hours, then linear clocks 102 for locale-1 and locale-2 are displayed with hour slots h and h+16 aligned, as it is the case for the cities of San Francisco (SFO) and Tokyo in FIG. 1, with 5am of SFO's linear clock aligned with 9pm of Tokyo's linear clock. For the illustrated embodiment, each hour slot is labeled. The label also includes the "+" sign if the time denoted is for the next day, and the "−" sign if the time denoted is for the previous day. For example, +9am in Tokyo means 9am, next day, in Tokyo.

For the illustrated embodiment, two colors are employed to differentiate daytime hour slots from evening hour slots. In other embodiments, other visual indications, such as shading or hatching, may be employed instead. In other embodiments, additional visual time differentiation, such as another visual indication (e.g. another color) to further differentiate the evening hour slots into early evening hour slots and nighttime hour slots, may also be employed. Beside differentiating AM/PM hours (or daytime/evening/nighttime hours) in each clock, this feature is especially helpful to someone attempting to schedule a conference with participants located in multiple time zones, by looking for a row of daytime denoted hour slots, such as the rows showing 8pm and 9pm for SFO. Those two hours are about the best two hours to have a conference calls involving participants located in SFO, Tokyo, Tel Aviv and New Delhi, as those two hours are about the only two hours that come close to having daylight in all four locations.

Additionally, a pair of crossbars 106*a* and 106*b* are employed to correlate the hour slots between the time clocks. Each crossbar 106*a*/106*b* is slidable (up and down for the illustrated vertical embodiment), and serves the purpose of facilitating a user in reading the time clocks, that is making it easier for the user to scan across the displayed time clocks to recognize that 3pm in Tel Aviv is 5am in SFO. This feature is especially helpful to a world traveler in determining when is a good time to call someone, e.g. a family member, in his/her home location from an oversea location. For example, the world traveler can quickly determine that since 3pm in Tel Aviv is 5am in his/her home location, SFO, therefore, it is probably not a good time to call someone in SFO, when it is 3pm in Tel Aviv.

Furthermore, together, crossbars 106*a* and 106*b* serve to facilitate the user in determining the time difference represented by the spatial distance between the two crossbars. More specifically, when the second crossbar 106*b* is placed at a spatial distance away from the first crossbar 106*a* (e.g. at 7am Tokyo (next day), while the first crossbar 106*a* is positioned at 5am SFO), a time difference (10 hours) will be displayed for the user. For the illustrated embodiment, the time difference is shown in the "head" of the second crossbar. Thus, the two crossbars 106*a* and 106*b* are very helpful to a traveler in determining flight time, for example, in the above example, where the traveler knows the flight is departing at 5am in SFO and arriving at 7am (next day) in Tokyo.

Figure 2:
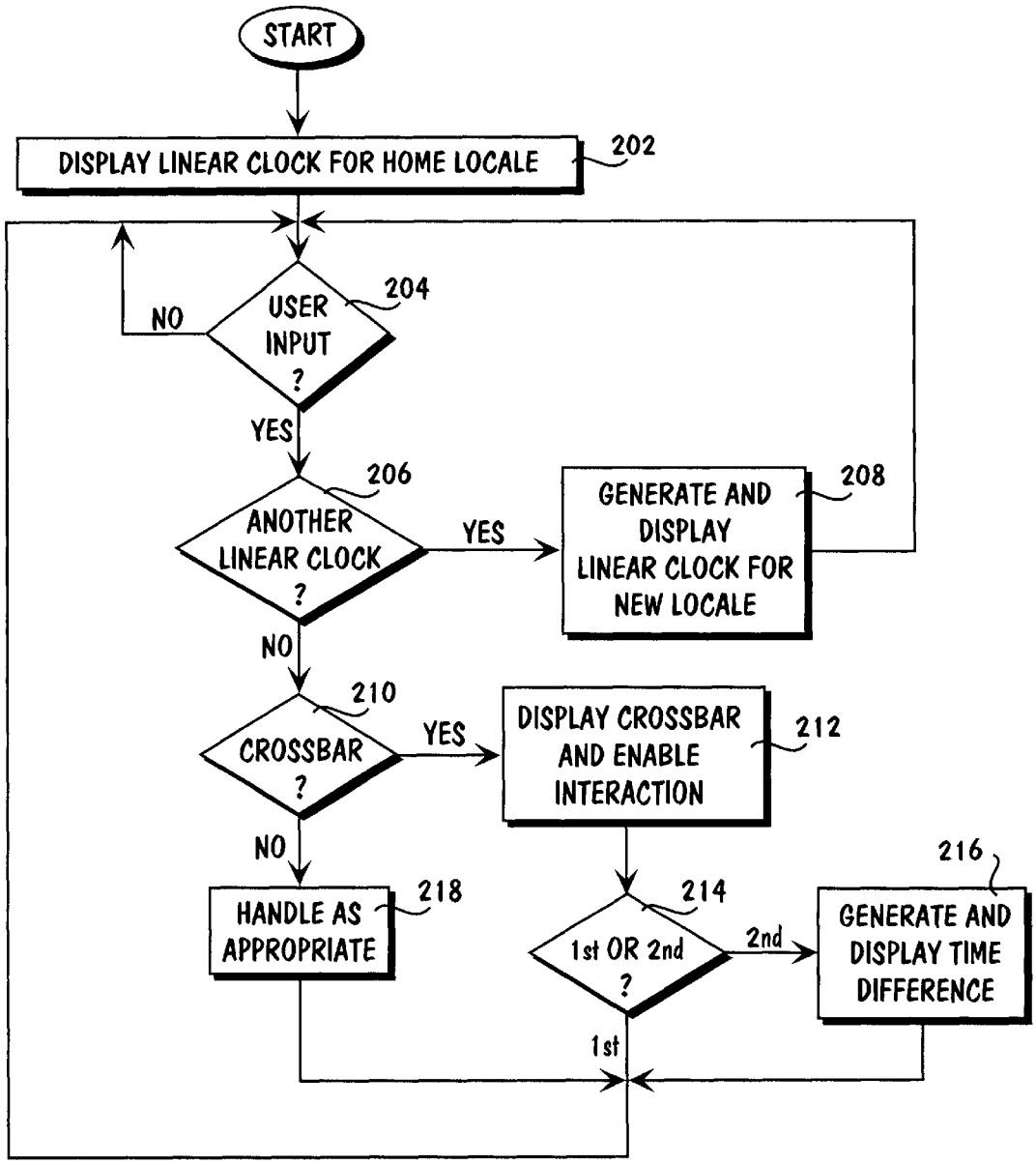
FIG. 2 illustrates one embodiment of the method of the present invention.

FIG. 2 illustrates one embodiment of the method of the present invention. As shown, at step 202, the linear clock for a first locale in a first time zone is displayed (typically the user's "home" locale). Next, at step 204, the user's input is awaited. Upon receiving the user's input, a determination is made to ascertain whether the user has requested another linear clock for a different locale (typically in a different time zone), step 206. If it is determined that the user has so requested, a linear clock for the specified locale is generated and displayed, step 208. Upon displaying the linear clock for the requested locale, the process continues at step 204 again. Note that in theory, with scaling, steps 204–208 may be repeated as many times as the user desires. However, in practice, it is likely to be more user friendly to impose a limit on the maximum number of linear clocks displayable, which is normally governed by the physical constraints of the display, as there is a point beyond which readability of the linear clocks will be so substantially degraded that it does not make practical sense to further scale the linear clocks to accommodate additional display.

Back at step 206, if it was determined that the user's request was not for another linear clock, for the illustrated embodiment, a determination is made then to ascertain whether the user has requested for a crossbar, step 210. If it is determined that the user has so requested, a slidable crossbar is generated and displayed at the specified time unit representation, step 212. Upon displaying the slidable crossbar at the specified time unit representation, another determination is made to ascertain whether that was the second crossbar, step 214. If it is determined that the crossbar was the second crossbar, a time difference represented by the spatial difference between the two crossbars is generated and displayed, step 216. Upon either determining that the crossbar was merely the first crossbar or upon displaying the time difference, the process continues at step 204 again.

Back at step 210, if it was determined that the user's request was not for a crossbar, for the illustrated embodiment, the user's request is handled in an application dependent manner, step 218. As those skilled in the art will appreciate, numerous other user requests, including addition/deletion of locales as well as maintenance of preferences may be supported. Some of these exemplary locale and preference maintenance requests will be described in further details below. In general, there is no limit to what other user functions may be practiced in conjunction with the linear time clock method of the present invention.

FIG. 3 illustrates one embodiment of a locale table suitable for use to practice the present invention. For the illustrated embodiment, table 300 includes a number of locale entries 302. Each locale entry 302 includes a number of fields, including a locale name field 304, a country field 306 and an abbreviation field 308 for storing the name, the country, and abbreviation of a locale, e.g. San Francisco, U.S.A. and SFO. Each locale entry 302 also includes a time zone specification 310, e.g. relative to Greenwich mean time, and whether daylight saving time applies to the locale 312. In other embodiments, more or less data fields as well as different data structures may be employed. In some embodiments, a number of locale entries are pre-stored in locale table 300, and the user is allowed to edit, as well as add to or delete the pre-stored locale entries. In one embodiment, one locale entry is provided for each time zone. In another embodiment, one locale entry is provided for each of the major cities, e.g. New York, Chicago, San Francisco, Los Angeles, Sydney, Tokyo, Shanghai, Beijing, New Delhi, and so forth.

FIG. 4 illustrates one embodiment of an input display suitable for use to edit or add to the pre-stored locale entries. For the illustrated embodiment, input display 400 includes a number of input fields 402, one for each of the supported data fields, e.g. locale name, country, abbreviation, GMT offset and whether daylight saving time applies. In the illustrated embodiment, the locale name field is referred to with the more user friendly label of "City". However, such labeling is not to be construed as limiting to the meaning of the term "locale". As defined earlier, it is to be broadly construed to include any geographical designation, including but not limited to village, town, county, and so forth, even though a "locale" may be loosely referred to as a "city" in part of the descriptions to follow. In one embodiment, if input display 400 was invoked to edit a selected locale entry, the data fields would have been filled with the locale data stored for the data fields. Additionally, input display 400 includes command buttons such as "done" and "cancel" 404. These command buttons provide their conventional functions, i.e., selection of the "done" button will cause the inputted data to be stored into the locale table, whereas selection of the "cancel" button will cause the input to be cancelled.

FIG. 5 illustrates one embodiment of a list display suitable for use to practice various aspects of the present invention. As illustrated, list display 500 lists the stored locale entries 502 displaying pre-selected ones of the supported data fields. Additionally, list display 500 includes lookup locale input field 504, scroll arrows 506, and an optional variable command button 508. In one embodiment, optional variable command button 508 may be a "new" button in one situation and a "del" button in another situation. Again, these field/command buttons provide their conventional functions, i.e., lookup locale input field allows the user to input the name of a locale to lookup the locale entry, without having to scroll up/down to locate the locale entry, and the scroll up/down arrows allows the user to cause the list to be scrolled up/down. Selection of the "new" button causes the above described input display to be rendered, and selection of the "del" button will cause the selected entry to be deleted from the locale table.

FIG. 6 illustrates one embodiment of a set of drop down menu suitable for use to cause the list to be displayed and practice other aspects of the present invention described above. As illustrated, menu set 600 includes drop down menus 602–604 for "Cities", "Options" and "Display". Menu 602, "Cities", includes the choices of "Show list", "Add City" and "Del City". For the illustrated embodiment, selection of "Show List" results in the display of a locale list as the one illustrated in FIG. 5, with optional command button 508 being enabled as the "new" button. Selection of "Add City" results in the rendering of an input display as the one illustrated in FIG. 4, whereas selection of "Del City" results in the display of a locale list as the one illustrated in FIG. 5, with optional command button 508 being enabled as the "del" button. Menu 604, "Options", includes the choices of "Home City", "City 1", "City 2", "City 3", and "City 4". For the illustrated embodiment, selection of any of the choices results in the display of a locale list as the one illustrated in FIG. 5, without enabling the optional variable command button. In response to the selection of any of the listed locale or "city", a linear clock is generated and displayed for the locale or "city", as illustrated in FIG. 1. Menu 606, "Display", includes the choices of "Day", "Evening", "$1^{st}$ Crossbar", and "$2^{nd}$ Crossbar". For the illustrated embodiment, selection of either "Day" or "Evening" results in a "pop up" (not illustrated) to allow a time to be entered denoting the hour the visual indication for daytime/evening hours should start. Selection of either "$1^{st}$ Crossbar" or "$2^{nd}$ Crossbar" results in the corresponding crossbar being rendered and "enabled" at a specified time unit representation (e.g. as denoted by the current position of a cursor). As described earlier, the rendering of the $2^{nd}$ crossbar will also include the display of the time difference represented by the spatial difference between the two crossbars. In an alternate embodiment, the $1^{st}$ crossbar is always rendered, and only the "$2^{nd}$ Crossbar" choice is offered. In yet another embodiment, where three visual indicators are employed to differentiate between daytime, evening and night hours, menu 606 also includes the choice of "Night" to allow a starting time for the "night hours" to be specified.

Figure 7:
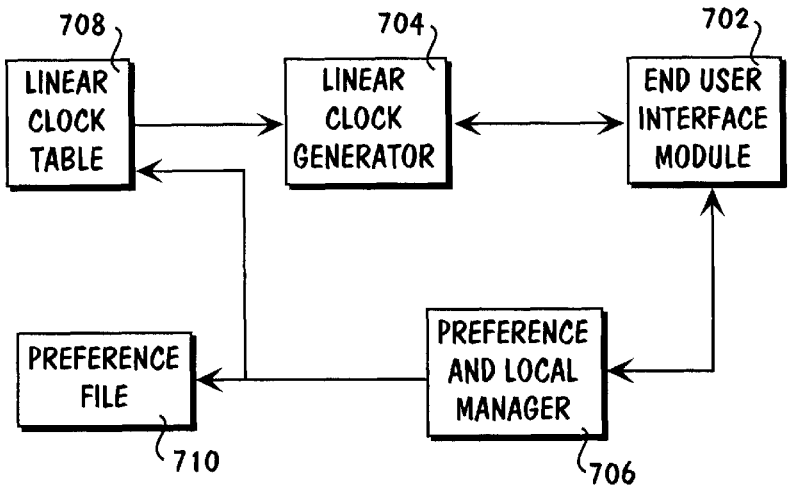
FIG. 7 illustrates one embodiment of a software architecture suitable for use to implement the present invention.

FIG. 7 illustrates an exemplary software architecture suitable for use to implement the present invention. As illustrated, the present invention may be implemented with end user interface module block 702, linear clock generator block 704, preference and locale manager block 706, locale table 708 and preference file 710. Locale table 708 is used to implement the locale table of FIG. 3, whereas preference file 710 is used to store the various user preferences, such as when daytime hours start, when evening hours start, and so forth. End user interface module block 702 is used to handle all interactions with the user, including rendering of the linear clocks, menus, input displays, list and so forth, as requested by linear clock generator block 704 and preference and locale manager block 706, as well as receive input requests/selections from the user on behalf of blocks 704 and 706. Linear clock generator block 704 is used to generate and cause the linear clocks of FIG. 1 to be rendered, whereas preference and clock manager block 706 is used to handle all other user interactions for preference and locale entry management described earlier. Those skilled in the art will appreciate that numerous other software architectures may be employed instead. Also, one or more of function blocks 702–706 or their equivalents may be implemented in hardware instead.

Figure 8:
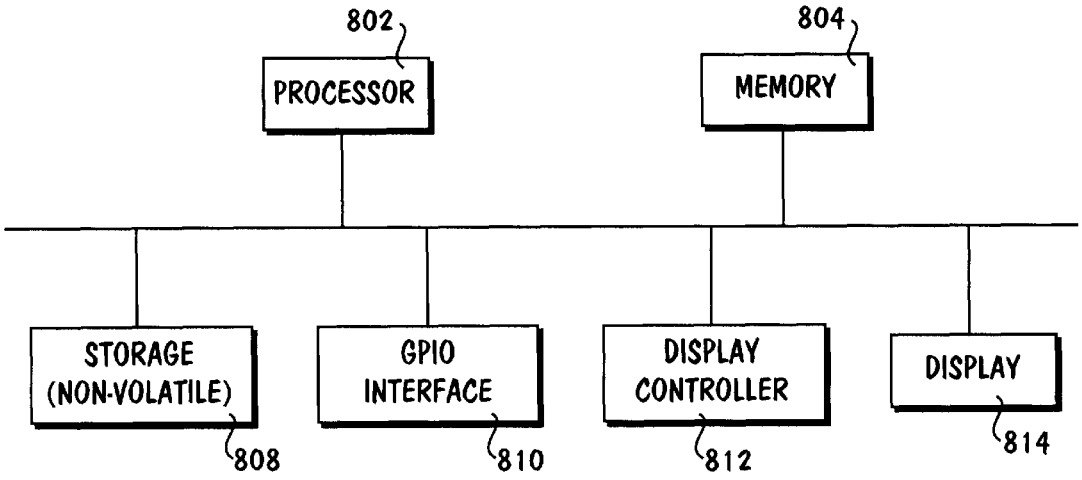
FIG. 8 illustrates one embodiment of a hardware architecture suitable for use to execute the software implementation of FIG. 7.

FIG. 8 illustrates an exemplary hardware architecture suitable for use to complement the software implementation of FIG. 7. As shown, for the illustrated embodiment, the hardware architecture includes processor 802, memory 804 and bus 806 coupled to each other as shown. Also coupled to bus 806 are non-volatile storage 808, general purpose I/O port 810, and display controller 812, to which display 814 is coupled. These elements perform their conventional functions known in the art. In particular, non-volatile storage 808 and system memory 814 are used to store a permanent and a working copy of the programming instructions for effectuating the teachings of the present invention, when executed by processor 802. The permanent copy of the programming instructions may be pre-loaded in the factory, field loaded from a distribution medium, such as a diskette, CD, DVD and so forth, or from a remote server. Except for their use to practice the present invention, the constitutions of elements 802–814 are known. Any one of a number of known implementations of these elements may be used. In other embodiments, more or less hardware elements may be employed. For examples, additional hardware elements may include communication interfaces, keyboard, pointing/stylus input devices, and so forth, whereas additional software elements may include other applications such as calendar, scheduling and/or email programs. The linear time display of the present invention may be incorporated as an integral part of these applications.

Figure 9A:
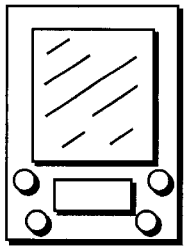
FIGS. 9*a*–9*f* illustrate various exemplary digital devices/systems incorporated with the teachings of the present invention.
Figure 9B:
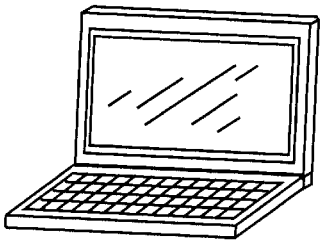
Figure 9D:
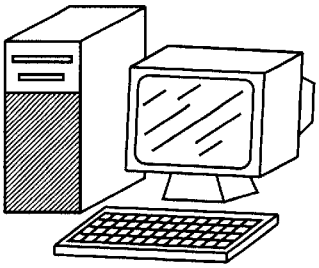
Figure 9E:
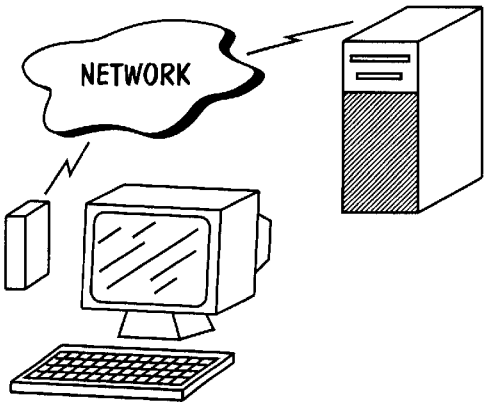
Figure 9C:
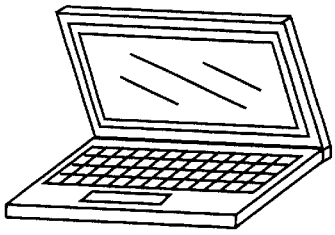
Figure 9F:
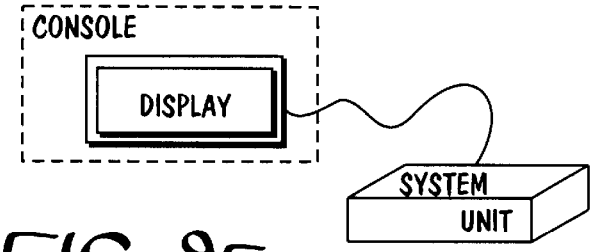

FIGS. 9*a*–9*f* illustrate a number of exemplary embodiments of digital devices/systems incorporated with the hardware-software implementation of FIGS. 7–8. As illustrated, the hardware-software implementation of FIGS. 7–8 may be embodied in a wide range of digital devices/systems, including but not limited to personal digital assistants (PDA), computer systems from palm/notebook computing devices at one end to mainframe computer at the other, and application specific digital systems such as on-board systems for private/commercial/military aircraft. FIGS. 9*a*–9*b* are intended to represent a broad range of PDA and palm computing devices known in the art, whereas FIGS. 9*c*–9*e* are intended to represent a broad range of computers, from laptops, desktops, to servers or mainframe serving terminals and/or thin clients. FIG. 9*f* is intended to represent a broad range of application specific systems such as on-board systems for private/commercial/military aircraft. Typically, the display is integrally mounted on a console, and the system unit is integrally mounted in an "equipment bay". As those skilled in the art will appreciate that these are just a number of exemplary embodiments of the present invention, numerous other digital devices/systems may be incorporated with the present invention using the hardware-software approach of FIGS. 7–8 or any one of a number of equivalents.

Thus, a linear time display has been described. While the present invention has been described in terms of the above illustrated embodiments, those skilled in the art will recognize that the invention is not limited to the embodiments described. The present invention can be practiced with modification and alteration within the spirit and scope of the appended claims. The description is thus to be regarded as illustrative instead of restrictive on the present invention.

What is claimed is:

1. An apparatus comprising:

a display; and a processor coupled to the display to cause a first and a second linear clock for a first and a second locale in a first and a second time zone to be rendered on said display in a linear and time-wise aligned manner, with each of said first and second clocks having a plurality of time unit representations (TURs), and the TURs of the first and second linear clocks are linearly and time-wise aligned with each other thereby allowing past, present and future TURs of said first and second linear clocks of said first and second locales to be correspondingly related to each other, and the processor further causing a first linear time correlation indicator to be rendered, correlating a first TUR of said first linear clock to a second TUR of said second linear clock, a second linear time correlation indicator to be rendered, correlating a second TUR of said second linear clock to a corresponding TUR of said first linear clock, and a time difference represented by the spatial difference between the first and second time correlation indicators to be rendered.

2. The apparatus of claim 1, wherein said processor causes said first and second linear clocks to be rendered in a selected one of a vertical and a horizontal orientation.

3. The apparatus of claim 1, wherein said processor causes at least two visual indicators to be employed to differentiate day time hours and evening time hours when causing said plurality of time unit representations to be rendered.

4. The apparatus of claim 3, wherein said processor causes at least two colors to be employed to differentiate day time hours and evening time hours, when causing at least two visual indicators to be employed to differentiate day time hours and evening time hours.

5. The apparatus of claim 1, wherein said first and second TURs of said first and second linear clocks are current time TURs of said first and second linear clocks.

6. The apparatus of claim 1, wherein the apparatus further comprises an enclosure integrally enclosing said display and said processor.

7. The apparatus of claim 1, wherein the apparatus further comprises a storage medium coupled to the processor, and having stored therein a plurality of programming instructions to be executed by the processor to cause said first and second linear clocks to be rendered on said display in said linear and time-wise aligned manner.

8. A storage medium having stored therein a first plurality of programming instructions to be executed by a host processor, wherein when executed, the first programming instructions cause the host processor of a first and a second linear clock for a first and a second time zone to be rendered on a display in a linear and time-wise aligned manner, with each of said first and second clocks having a plurality of time unit representations (TURs) and the TURs of the first and second linear clocks linearly and time-wise aligned with each other, thereby allowing past, present and future TURs of said first and second linear clocks of the first and second locales to be correspondingly related to each other, and the programming instructions further cause the host processor to render a first linear time correlation indicator, correlating a first TUR of said first linear clock to a second TUR of said second linear clock, a second linear time correlation indicatr, correlating a second TUR of said second linear clock to a corresponding TUR of said first linear clock, and a time difference represented by the spatial difference between the first and second time correlation indicators to be rendered.

9. The storage medium of claim 8, wherein the first programming instructions further cause said first and second linear clocks to be rendered in a selected one of a vertical and a horizontal orientation.

10. The storage medium of claim 9, wherein the first programming instructions cause at least two visual indicators to be employed to differentiate day time hours and evening time hours when causing said plurality of time unit representations comprises to be rendered.

11. The storage medium of claim 8, wherein the storage medium further comprises a second plurality of programming instructions to be executed by the host processor to provide calendar function.

12. A method comprising:

a processor rendering on a display a first linear clock for a first locale in a first time zone; and the processor rendering on said same display a second linear clock for a second locale in a second time zone, wherein said first and second linear clocks are rendered in a linear and time-wise aligned manner, with each of said first and second clocks having a plurality of time unit representations (TURs) and the TURs of the first and second linear clocks are linearly and time-wise aligned with each other, thereby allowing past, present and future TURs of said first and second linear clocks of said first and second locales to be correspondingly related to each other, and the processor further rendering a first linear time correlation indicator correlating a first TUR of said first linear clock to a second TUR of said second linear clock, a second linear time correlation indicator correlating a second TUR of said second linear clock to a corresponding TUR of said first linear clock, and a time difference represented by the spatial difference between the first and second time correlation indicators.

* * * * *